US006250750B1

(12) United States Patent
Miyazawa et al.

(10) Patent No.: US 6,250,750 B1
(45) Date of Patent: Jun. 26, 2001

(54) INK CARTRIDGE AND LOADING MECHANISM FOR INK CARTRIDGE

(75) Inventors: Hisashi Miyazawa; Takao Kobayashi; Hisashi Koike; Hitoshi Igarashi; Masanori Yoshida, all of Nagano (JP)

(73) Assignee: Seiko Epson Corporation, Nagano-ken (JP)

( * ) Notice: Subject to any disclaimer, the term of this patent is extended or adjusted under 35 U.S.C. 154(b) by 0 days.

(21) Appl. No.: 08/888,936

(22) Filed: Jul. 7, 1997

(30) Foreign Application Priority Data

| | | |
|---|---|---|
| Jul. 5, 1996 | (JP) | 8-195626 |
| Aug. 14, 1996 | (JP) | 8-233588 |
| May 30, 1997 | (JP) | 9-158009 |

(51) Int. Cl.[7] ..... B41J 2/175
(52) U.S. Cl. ..... 347/87; 347/86
(58) Field of Search ..... 347/20, 50, 84, 347/85, 86, 87, 49; 399/262

(56) References Cited

U.S. PATENT DOCUMENTS

| | | | | |
|---|---|---|---|---|
| 4,794,409 | | 12/1988 | Cowger et al. | 347/86 |
| 4,961,518 | | 10/1990 | Shoji et al. | 222/107 |
| 5,182,581 | | 1/1993 | Kashimura et al. | 347/87 |
| 5,477,963 | | 12/1995 | Mochizuki et al. | 206/701 |
| 5,521,624 | | 5/1996 | Matsuda et al. | 347/87 |
| 5,633,667 | * | 5/1997 | Miyazawa | 347/86 |
| 5,748,210 | * | 5/1998 | Watanabe et al. | 347/50 |
| 5,790,158 | * | 8/1998 | Shinada et al. | 347/86 |
| 5,915,155 | * | 6/1999 | Shoji et al. | 399/262 |

FOREIGN PATENT DOCUMENTS

| | | |
|---|---|---|
| 195 34 577 | 3/1996 | (DE) . |
| 0 536 980 | 4/1993 | (EP) . |
| 0 546 832 | 6/1993 | (EP) . |
| 0 551 752 | 7/1993 | (EP) . |
| 2 269 784 | 2/1994 | (GB) . |
| 2-522 | 1/1990 | (JP) . |
| 2-214665 | 8/1990 | (JP) . |
| 5-169661 | 7/1993 | (JP) . |
| 7-32520 | 6/1995 | (JP) . |
| 7-32049 | 7/1995 | (JP) . |

* cited by examiner

*Primary Examiner*—N. Le
*Assistant Examiner*—Anh T. N. Vo
(74) *Attorney, Agent, or Firm*—Stroock & Stroock & Lavan LLP

(57) ABSTRACT

Reinforcing ridges are formed so as to project from corner portions of peripheral walls, and an opening end edge is made thick-walled, so that an ink cartridge having a sufficient rigidity can be molded using vapor impermeable soft synthetic resins. In addition, shape keeping ribs are formed so as to project from the outer sides of longitudinal ribs that are formed on an inner surface of a cover body, so that deformation of the cartridge can be suppressed during vibration welding. Further, an engaging recess arranged in a lower surface of an ink cartridge is adapted to receive a support rod of an ink cartridge loading mechanism. A carriage cover body of the loading mechanism is closed as a lifter is guided with a guide groove which is parallel to the axial center of an ink supply needle so that the ink cartridge is allowed to descend correctly toward a recording head, so that the ink cartridge can be loaded correctly without breaking the ink supply needle.

39 Claims, 11 Drawing Sheets

INK CARTRIDGE AND LOADING MECHANISM FOR INK CARTRIDGE

BACKGROUND OF THE INVENTION

1. Field of the Invention

The present invention relates to an ink cartridge used for an ink jet printer and a loading mechanism for such an ink cartridge.

2. Description of the Prior Art

Printers designed to make a recording using a liquid ink, particularly ink jet printers, use an ink cartridge such as disclosed by the present applicant in Japanese Patent Publications Nos. Hei. 5-270001 and Hei. 7-125238.

An ink cartridge of this type is usually formed of polystyrene having an appropriate degree of shape keeping property, and an ink is charged into such ink cartridge under reduced pressure. Since polystyrene is easily permeated by water vapor, if the ink cartridge has been in storage for a long period of time, the viscosity of the ink is increased due to evaporation of moisture, which in turn imposes the problem of defective jetting of ink droplets out of nozzles and hence impairs reliability. In addition, if an ink whose surface tension is low is used to allow ink droplets to be jetted out of tiny nozzles, bubbles are produced during ink charging operation under reduced pressure and film bonding operation, which in turn causes inconvenience that the ink spouts out of the ink cartridge.

By the way, an ink cartridge used for serial type ink jet printers requires that an ink supply needle projecting from the back of a recording head be correctly aligned with an ink supply port independently of its load ability to a carriage.

To achieve such object, a loading mechanism for loading an ink cartridge to a carriage proposed in Japanese Utility Model Publication No. Hei 7-32049 is characterized as pushing an engaging projection toward the recording head while engaging the engaging projection with an engaging groove formed in a side surface of the ink cartridge by turning a lever, the engaging projection projecting from an inner side surface of the lever.

However, such loading mechanism suffers from the disadvantage that since the engaging projection turns about the pivot together with the lever, a component force directed at right angles to the recording head is applied to the ink cartridge due to friction with the engaging projection. As a result, such component force is likely to break the supply needle projecting from the back of the recording head.

SUMMARY OF THE INVENTION

Generally speaking in accordance with the invention, an ink cartridge having an ink cartridge main body being molded using a soft synthetic resin material is provided. Reinforcing and positioning ridges are formed so as to project from a corner portion of a peripheral wall of the ink cartridge main body. The walls of the main body form an opening. An opening end edge of the ink cartridge main body is thick-walled. A cover body covers an opening of said ink cartridge main body. The cover body including a charged foam pressing ridge being formed so as to project from an inner surface of said cover body in a longitudinal direction and pressing a charged foam disposed in said ink cartridge main body. A shape keeping ridge coming in contact with an inner side surface of said opening end edge of said ink cartridge main body and being formed on an outer side of said charged foam pressing ridge. The charged foam pressing ridge may be formed integrally with said shape keeping ridge.

The ink cartridge includes a recess adapted to be coupled with part of a lifter member. The recess and an ink supply port are formed in a lower surface of the ink cartridge main body. A loading mechanism for an ink cartridge includes a cartridge loading member having an ink supply needle communicating with a recording head and projected toward an inner depth thereof A guide is formed on one side of an inner surface of the cartridge loading member, the guide extending in parallel to an axial center of the ink supply needle. A cover body is pivotally attached to an opening in the cartridge loading member. A lifter member is supported by the cover body, the lifter member being displaceable with a free end thereof guided by the guide portion, the cover body being pivotally attached adjacent an opening of said cartridge loading member. A support rod disposed on a free end portion of said lifter member, the support rod supporting the ink cartridge while being engaged with a recess formed in a lower surface of the ink cartridge.

Accordingly, it is an object of the present invention to provide a novel ink cartridge having a sufficient rigidity even if a soft material, including a synthetic resin such as polypropylene, which is highly water vapor impermeable, but has poor shape keeping property, is used as the construction material.

Another embodiment of the present invention is to provide a novel ink cartridge that does not cause ink to spout as a result of bubbling produced during the ink charging operation and the like.

Still another object of the present invention is, therefore, to provide a novel ink cartridge and a loading mechanism for such novel ink cartridge that can load and unload the ink cartridge correctly in parallel to the axial center of an ink supply needle.

Still other objects and advantages of the invention will in part be obvious and will in part be apparent from the specification.

The invention accordingly comprises the features of constructions, combination of elements, and arrangement of parts which will be exemplified by the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2(*b*) is a bottom plan view of a cartridge constructed in accordance with a second embodiment of the invention;

FIG. 3(*b*) is a cross-sectional view of the cover body constructed in accordance with the invention;

FIG. 9(*b*) is a cross-sectional view of the cover body constructed in accordance with the invention;

DETAILED DESCRIPTION OF THE PREFERRED EMBODIMENTS

Figure 1:
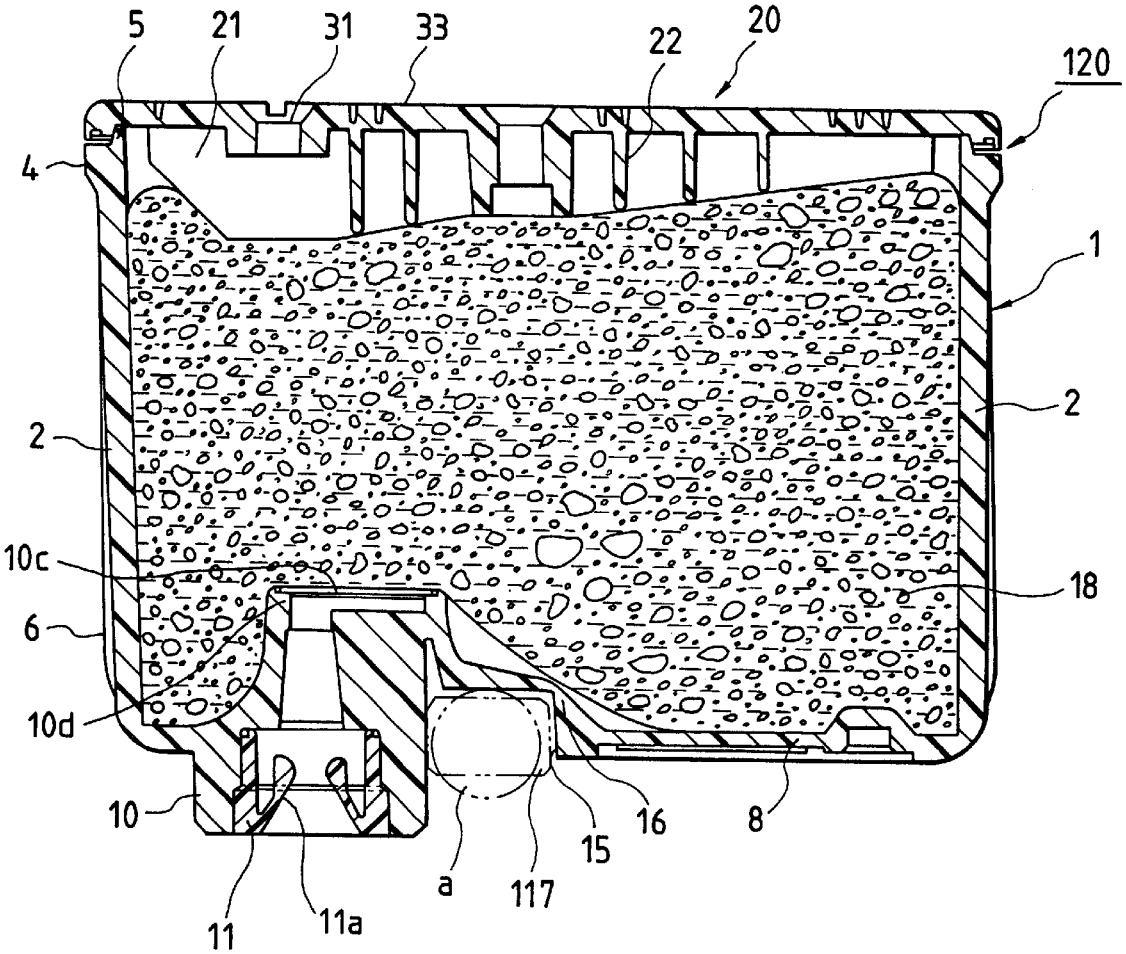
FIG. 1 is a sectional view of an ink cartridge constructed in accordance with the present invention.

Reference is first made to FIGS. 1 to 6, which show an ink cartridge 120 which includes an ink cartridge main body 1. Ink cartridge main body 1 is made of a soft synthetic material such as polypropylene and is substantially a rectangular solid in structure. Ink cartridge main body 1 is formed of a bottom surface 8, opposed end walls 2 and opposed side wall disposed between respective end walls 2 to form an open ended container. Both end walls 2, 2, extending in the lengthwise direction of the peripheral walls of the main body 1, are made thicker than the side walls 3, 3 which extend in the widthwise direction. An opening edge 4 disposed at the top of end walls 2 and side walls 3 is also made thick so as to protrude outward from main body 1. Coner portions 2*a* where each end wall 2 meets a respective side wall 3. Ridges 6 are integrally formed with walls 2, 3 so as to project from the vicinity of corners 2*a*. Ridges 6 serve not only to position the ink cartridge main body 1 with respect to a not shown cartridge holder but also to keep the shape of the ink cartridge main body 1 itself. As a result of this construction, the ink cartridge main body 1 is given a sufficient rigidity to maintain its shape whereas absent the structures discussed here and below a soft synthetic material, as used herein, would have insufficient rigidity to maintain its structural integrity.

In the preferred embodiment, side walls 3 have a thickness of about 1.5 mm while the thicker end walls 2 have a thickness of about 1.7 mm. Open end edge 4 extends for a height of about 3.0 mm and has a thickness of about 2.25 mm; thicker than the thickest end walls. By until end walls having a thickness of about 1.7 mm while maintaining side walls at the conventional thickness of 1.5 mm, and extending the height and thickness of the opening end edge 4, it is possible to provide rigidity sufficient to withstand vibration fusing to a polypropylene container without diminishing the internal capacity for ink while allowing the ink cartridge to be dropped into an ink cartridge holder for a printer.

Figure 2A:
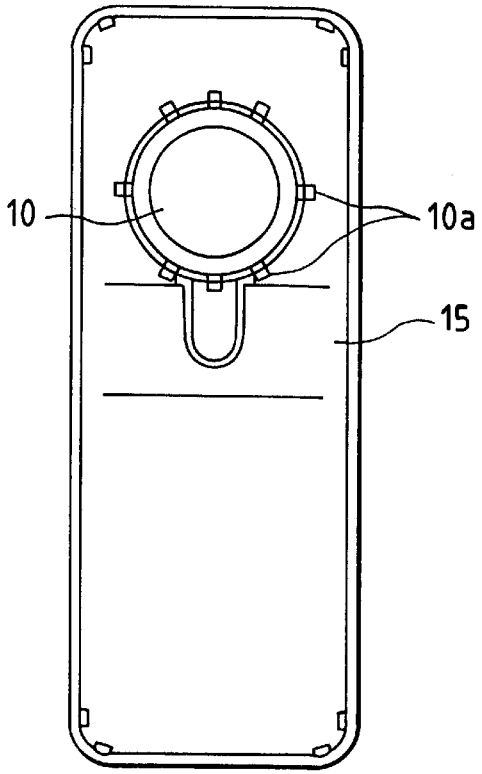
FIG. 2(*a*) is a bottom plan view showing a cartridge constructed in accordance with the invention.
Figure 2B:
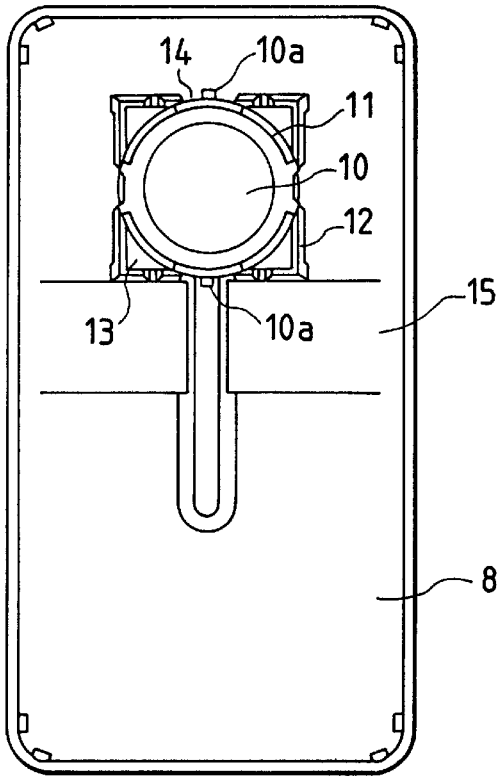

An ink supply port 10 having such a cylindrical shape as shown in FIG. 2(*a*) is formed on one side of bottom surface 8 of the ink cartridge main body 1 so as to project away from the bottom surface 8. Ink supply port 10 also has a projecting portion 10*d* which projects inwardly of ink cartridge 120. A filter 10*e* is disposed on projecting portion 10*d* to prevent dirt or other contaminants from entering ink supply port 10. A gasket 10*f* is disposed within ink supply port 10 to receive an ink supply needle and forms a seal therewith. Gasket ring 10*g* extending towards filter 10*c* forms a fluid tight seal with the ink needle.

This embodiment is particularly characterized in that the ink supply port 10 is formed so as to project from the bottom surface in such a manner that a cylindrical portion 11 of ink port 10 formed on the inner side thereof is enclosed by a square cylindrical portion 12 on the outer side as shown in FIG. 2(*b*). As a result of this construction, the comer portions of a film need no longer be cut with a press or the like at the time of sealing the ink supply port 10, and gaps 13, between the cylindrical portion 11 and the square cylindrical portion 12, are taken advantage of as an air release portion at the time of bonding the film. Further, by arranging several notched portions 14 on the top edges of the square cylindrical portion 12, such notched portions are taken advantage of as an air release portion for releasing air inside at the time of bonding the film.

In this ink supply port 10, several long positioning ridges 10*a* or grooves are integrally formed on an outer peripheral surface of cylindrical portion 11 so as to extend in a cartridge setting direction so that the ink supply port 10 can be used for a plurality of types of printers, and by bringing some of the ridges 10*a* or grooves into contact with the corresponding contact surfaces of the recording head, the axial center of the ink supply port 10 can be aligned with respect to the ink supply needle correctly.

An engaging recess 15 extending across the width of the ink cartridge main body 1 is formed in the bottom surface 8 of the ink cartridge main body 1 in such a manner that the engaging recess 15 is located adjacent to the ink supply port 10. Engaging recess 15 is adapted to engage a support rod a (FIG. 1) as discussed below. By engaging the recess 15 with a support rod a of a lifter disposed on a cartridge holder, erroneous attachment of the ink cartridge main body to the cartridge holder can be prevented. Further, an inwardly projecting stepped portion 16 which does not come in contact with a foam 18 charged in the ink cartridge main body 1, is formed adjacent engaging recess 15, across engaging recess 15 from ink supply port 10, to reduce the empty space within main body 1 so that the amount of ink not absorbed by the foam 18 is reduced. As a result, the inwardly projecting stepped portion 16 not only allows the ink to be used to the last drop, but also allows a space to be provided for evacuating the ink and sealing the cartridge within a vacuum sealed aluminum packaging.

Figure 3A:
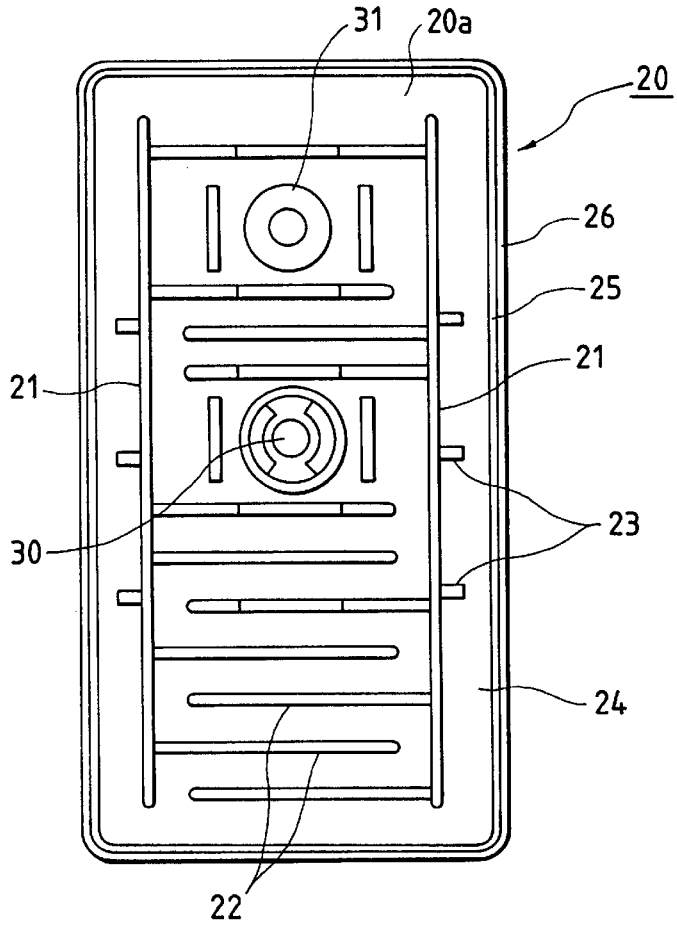
FIG. 3(*a*) is a plan view of the inner surface of a cover body of the cartridge constructed in accordance with the invention.
Figure 3B:
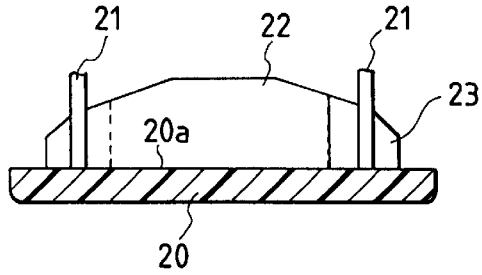
Figure 6:
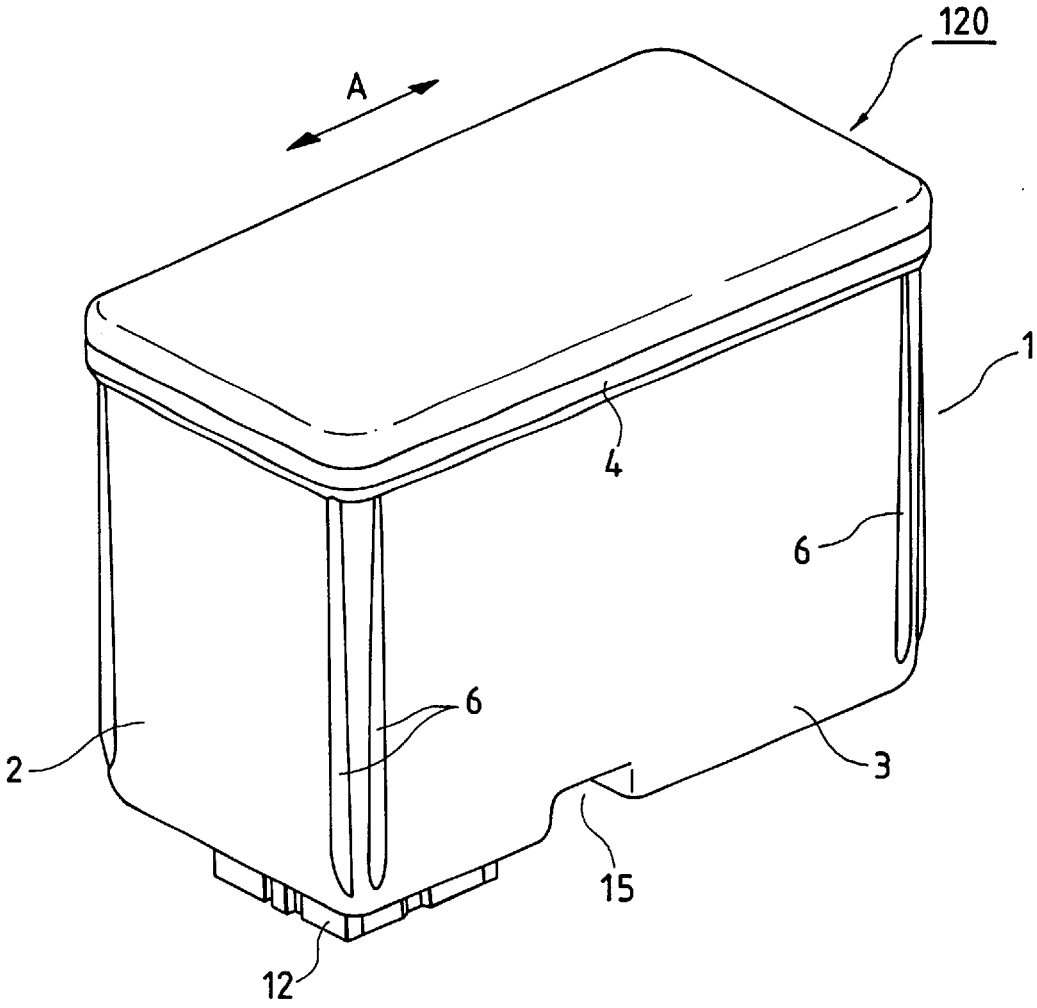
FIG 6 is a perspective view of the cartridge constructed in accordance with the invention.
Figure 7:
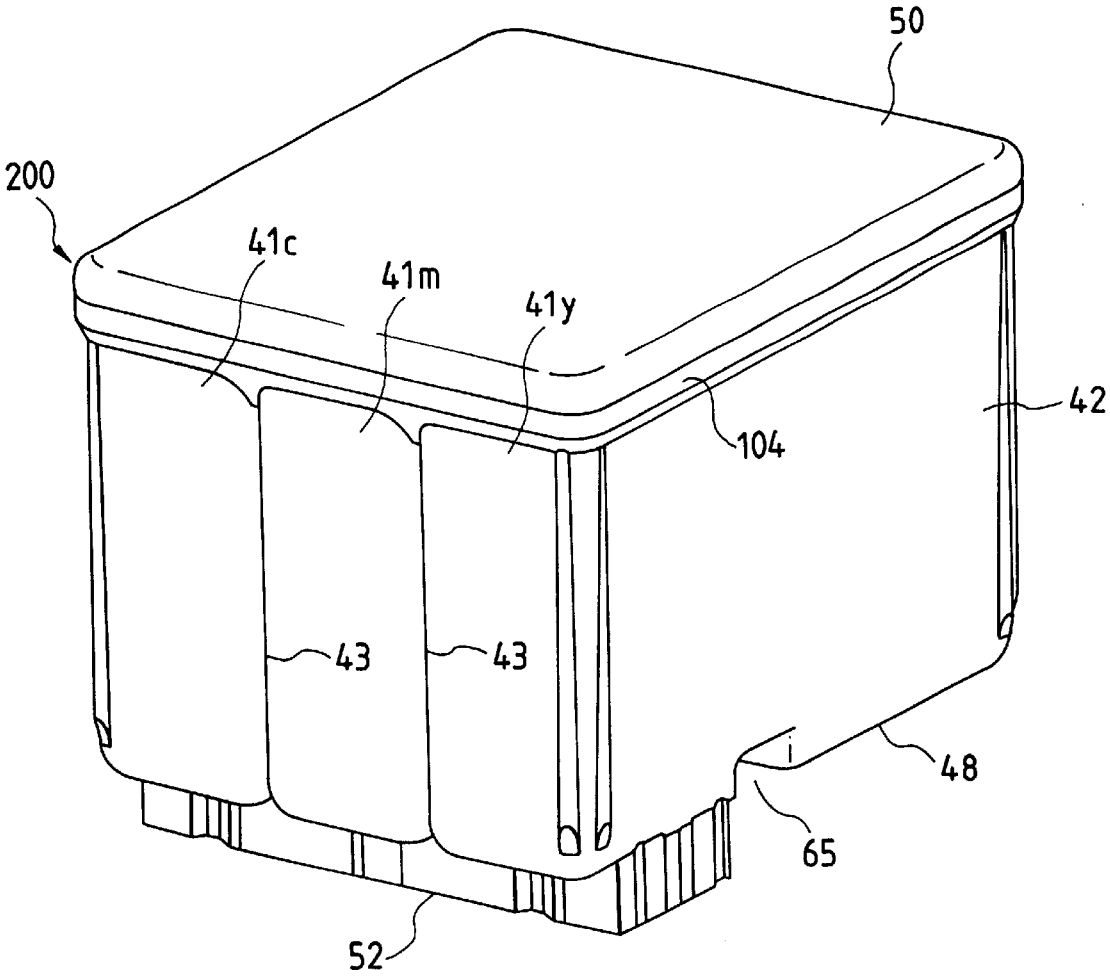
FIG. 7 is a perspective view of an ink cartridge for a color printer, constructed in accordance with a third embodiment of the present invention.
Figure 8:
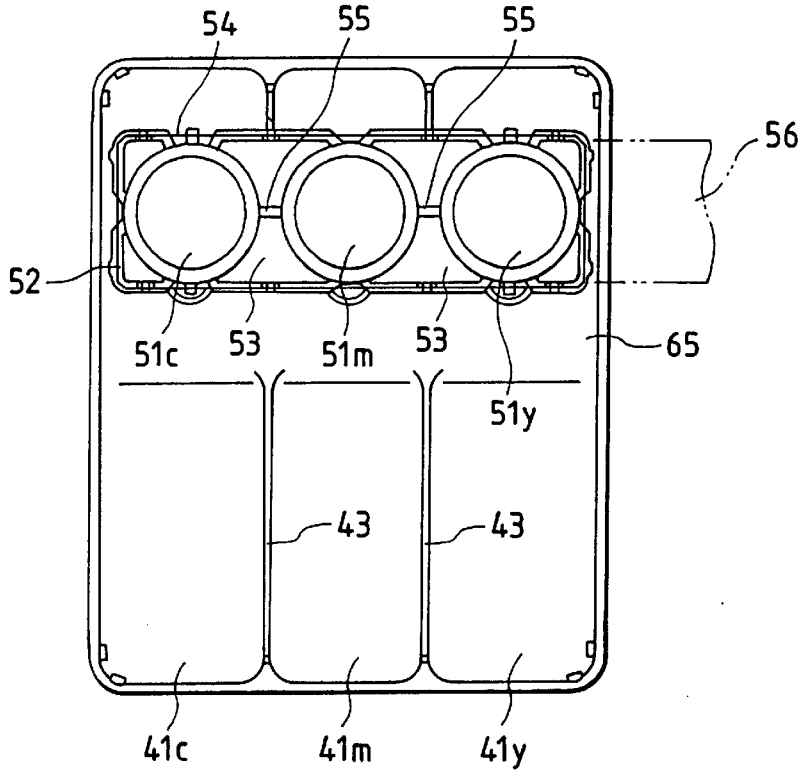
FIG. 8 is a bottom plan view of the cartridge constructed in accordance with the third embodiment of the invention.

A cover body 20 seals the opening of the ink cartridge main body 1. As shown in FIG. 3, two rows of longitudinal ribs 21, 21 are formed at an interval so as to project from the inner surface 20*a* of the cover body 20. The longitudinal ribs 21, 21, which may serve as charged foam pressing ridges to press the foam 18 contained inside the ink cartridge main body 1, are long enough to slide the cover body 20, in the longitudinal directions, to some extent along cartridge main body 1 in the direction of double headed arrow A (FIG. 6). Further, by making the portions of these ribs 21, 21 that are closer to the ink supply port 10 higher than other portions thereof, the foam 18 on these higher portions is compressed more strongly against inwardly projecting portion 10*a* of ink port 10 and the empty pores of the foam 18 are reduced, so that a strong capillary force can be obtained. As a result of such strong capillary force, the ink within the foam 18 is gathered toward the ink supply port 10. Moreover, between these longitudinal ribs 21, 21, a plurality of horizontal ribs 22 are erected so as to be substantially orthogonal to the longitudinal direction and with one end thereof being distanced from the corresponding longitudinal rib 21 alternately so that a zigzag passage is formed along inner surface 20*a*. Because the passage is zigzag the path through the zigzag is greater than the distance from one end of cover body 20 to an air release hole 31. As a result of this construction, bubbles of ink produced at the time of evacuation can be separated into ink and air during the process of guiding such bubbles to an air release hole 31 via the zigzag passage, so that only air is released outside.

Figure 5:
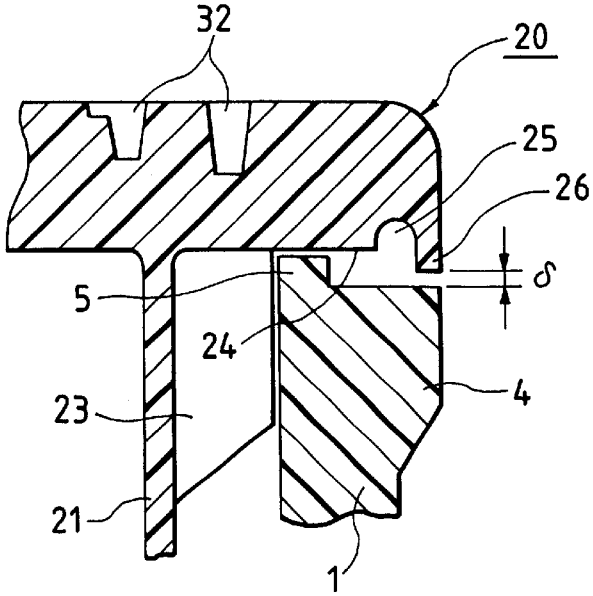
FIG. 5 is an enlarged sectional view showing a main portion of the cartridge and the cover body constructed in accordance with the invention.

On the other hand, as shown in FIG. 3, several reinforcing ribs 23 are formed so as to project from the longitudinal ribs 21 outside and so as to come in contact with the inner side surface of the opening edge 4 of the ink cartridge main body 1. The reinforcing ribs 23, serving to suppress inward flexion of the opening edge 4, extend so as to be substantially orthogonal to the longitudinal direction (ribs 21). Further, as shown in FIG. 5 in enlarged form, the portion of cover 20 extending beyond the reinforcing rib 23 forms a welding surface 24 that is to be welded with a welding margin 5 projecting from the top surface of the opening edge 4. An outer peripheral projecting edge 26 is formed on a portion of cover body 20 extending beyond the welding surface 24. A slender groove 25 receives blurs produced at the time of welding.

Figure 4:
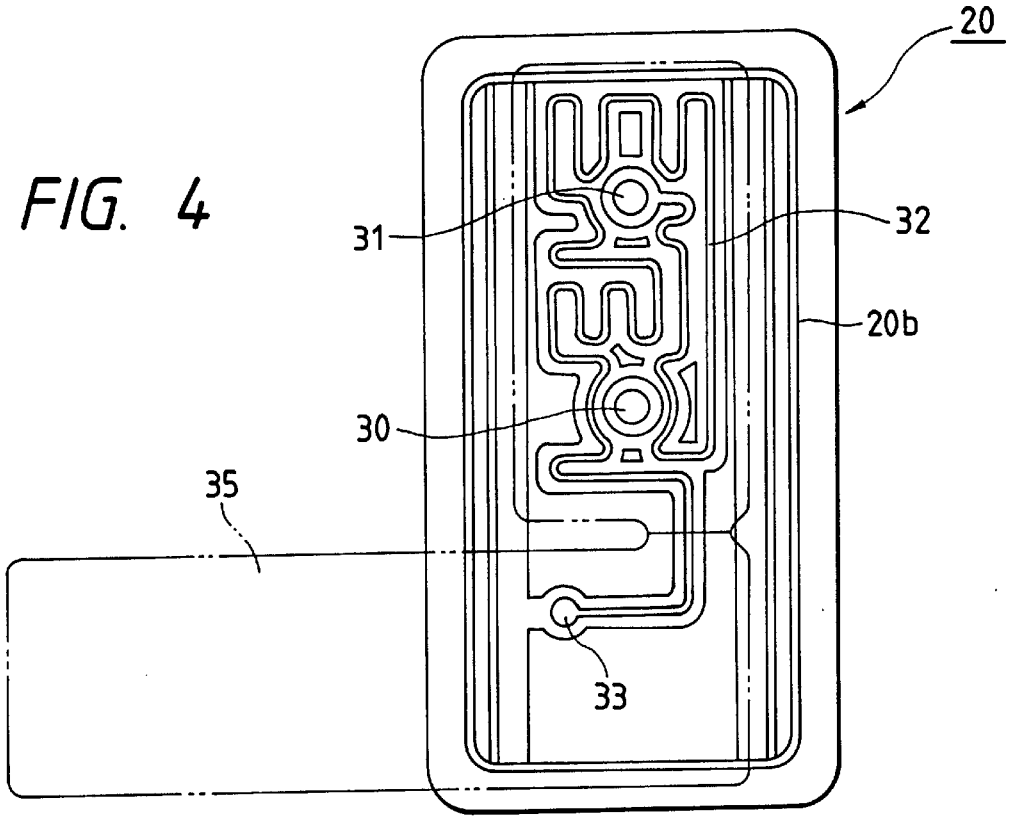
FIG. 4 is a top plan view of the cover body constructed in accordance with the invention.

As shown in FIG. 4, an ink charging hole 30 and the air release hole 31 are formed so as to pass through the middle portion and a second portion of the upper surface 20*b* of the cover body 20, the second portion being close to the ink supply port 10. Further, a snake groove 32 is formed in this upper surface 20*b* so as to be labyrinth like. Snake groove 32 represents the sinusoidal waveform shape of a slithering snake in which all waves in the path need not be uniform. The head end of the snake groove 32 communicates with the air release hole 31 and the tail end thereof forms a through hole portion 33 communicating with a film 35 attached across a portion of cover body 20. The snake groove 32 is arranged so as to prevent evaporation of the ink inside the cartridge in using the ink cartridge. That is, when the tail end of the film 35 has been peeled off and the cartridge main body 1 has been opened onto the atmosphere through the snake groove 32, the snake groove 32 that is long prevents the ink from evaporating. Hereupon, the shape of the snake groove 32 is always the same independently of type of the ink cartridge 120, for example, the ink cartridges having different types of cover bodies 20 as shown in FIGS. 2(*a*) and 2(*b*) and the ink amount which can be charged being different from each other. Therefore, the film 35 having the same width can be used for covering the snake groove 32 regardless.

In the thus constructed embodiment, when the cover body 20 is placed on the thick-walled opening edge 4 so as to cover the opening of the cartridge main body 1 and slid along the length in either direction of two headed arrow A in FIG. 6 (direction of vibration fusing for integrating the cover body 20 and the cartridge main body 1, snake groove 32, not shown in FIG. 6 for simplicity), the opening edge 4 of the cartridge main body 1 allows the projecting welding margin 5 to be welded with the welding surface 24 on the inner surface of the cover body 20 without being deformed while supported by the reinforcing ribs 23 that project from the outside of the longitudinal ribs 21. At the same time, both the opening edge 4 and the cover body 20 are integrated with each other while leaving a gap δ amounting to some 0.2 mm therebetween and allowing the burs produced during welding to be contained in the slender groove 25 formed in the inner surface of the cover body 20.

Then, an ink having a small surface tension is charged into the main body 1 through the ink charging hole 30 arranged in the cover body 20. Then while evacuating the ink cartridge, the cartridge 120 is positioned so as to be kept inclined by about 30° so that the air release hole 31 is positioned at a higher position than ink charging hole 30. The film 35 is bonded onto the upper surface of the cover body 20. As a result, bubbles produced within the foam 18 are separated from the ink while passing through the long zigzag passage formed by the horizontal ribs 22, and only air flows out to the upper surface of the cover body 20 from the air release hole 31, and further flows out into the through hole portion 33 that is in contact with the film 35 via the snake groove 32.

In contradistinction thereto, FIGS. 7 to 10 which show an ink cartridge, generally indicated as 200 adapted for color printers, constructed in accordance with a third embodiment of the present invention.

Ink cartridge 200 includes a cartridge main body 40 having three ink tanks 41*c*, 41*m*, 41*y* separated by partitions 43 to contain a cyan ink, a magenta ink, and a yellow ink separately. A single cover body 50 covers the upper openings of these ink tanks 41*c*, 41*m*, 41*y*.

Cylindrical ink supply ports 51*c*, 51*m*, 51*y* are formed at one end of bottom surface 48 of respective ink tanks 41*c*, 41*m*, 41*y* so as to project from the bottom surface 48 of cartridge main body 40. Further, these ink supply ports 51*c*, 51*m*, 51*y* are connected to one another through ribs 55, 55, and the outer circumferences thereof are surrounded by a common frame 52 that is rectangular as viewed in plan.

As a result of this construction, the respective ink supply ports 51*c*, 51*m*, 51*y* can be sealed simultaneously by using a single long tape 56. The air entrapped at the time of sealing the ports is driven into an air release portion 53 formed around these ink supply ports and caused to escape through notches 54 formed in the upper edge of the frame 52. Hence, the tape 56 can be bonded reliably.

A common recess 65 is formed on the bottom surfaces 48 of these ink tanks 41*c*, 41*m*, 41*y* so as to extend across these ink tanks. Ink tank 200 also includes an internal stepped portion adjacent respective ink ports 51*c*, 51*m*, 51*y*. The recess 65 serves not only as a portion to be retained in part of the cartridge holder, but also, with its corresponding internal stepped portion, provides a portion that prevents the foam 18 from coming in contact with the space adjacent ink supply port 10, so that the amount of ink that is not absorbed by the foam 18 is reduced and a space for evacuation packaging by aluminum packaging can be provided as in ink tank.

Figure 9A:
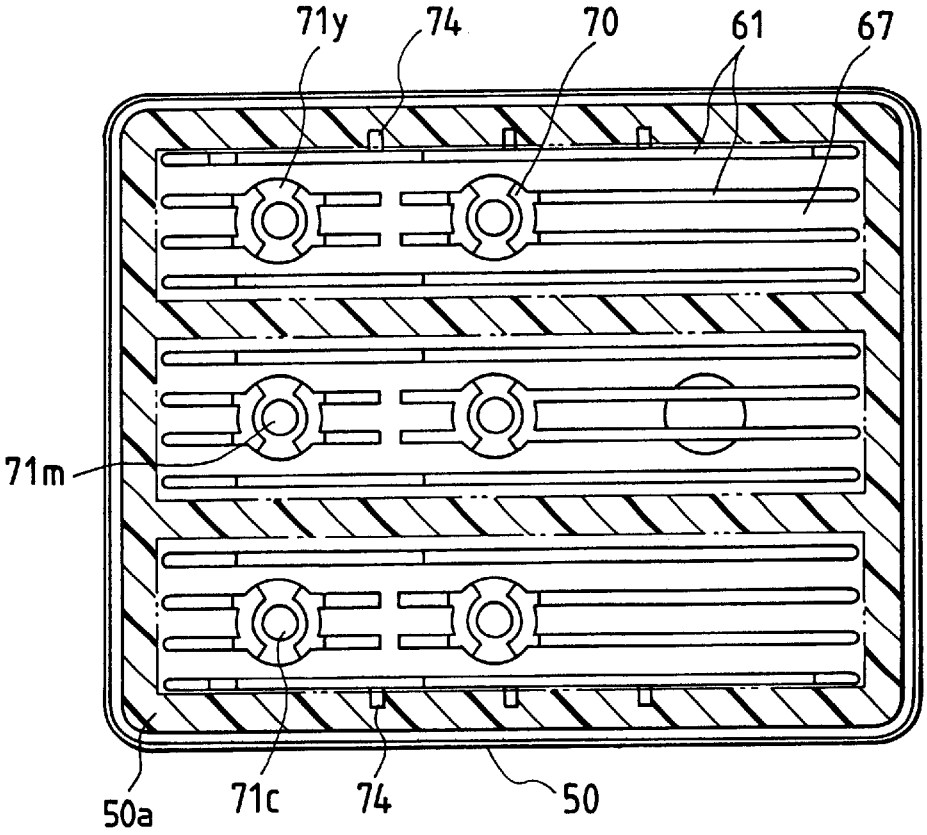
FIG. 9(*a*) is a plan view of the inner surface of a cover body of the cartridge constructed in accordance with the third embodiment of the invention.
Figure 9B:
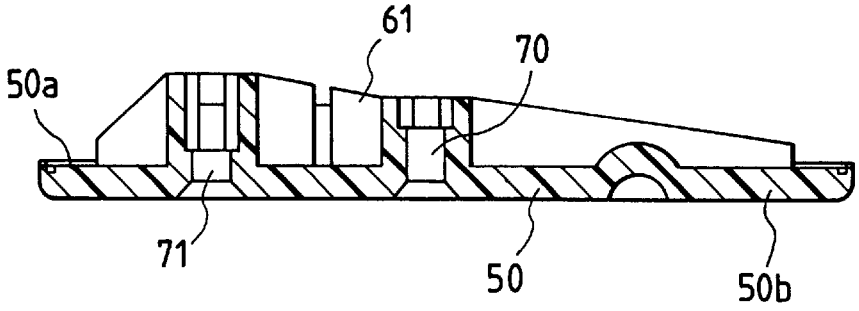

As shown in FIGS. 9(*a*), 9(*b*), several longitudinal ribs 61, for pressing these foams 18 within each respective tank 41*c*, 41*m*, 41*y*, are arranged so as to project from the inner surface 50*a* of the cover body 50 in the longitudinal direction for the respective ink tanks 41*c*, 41*m*, 41*y*. Portion of these ribs 61, those closer to the respective ink supply ports 51*c*, 51*m*, 51*y*, are made higher, so that the foams in proximity to these portions are pressed and deformed with stronger forces. In addition, two inwardly located longitudinal ribs 61, 61 out of these longitudinal ribs 61, of each ink tank 41*c*, 41*m*, 41*y* are brought into contact with a corresponding ink charging sleeve 70, so that a passage 67 formed between the ribs 61 and the ink charging sleeve 70 is closed lest bubbles should flow directly to an air release hole 71 arranged closer to the corresponding ink supply port 51.

It may be noted that reference numeral 74 in FIGS. 7 to 10 denotes a shape keeping rib that is formed on inner surface 50*a* of body cover 50, so as to project beyond the outermost longitudinal ribs 61, 61 in a direction substantially orthogonal to the longitudinal direction. By bringing these shape keeping ribs 74 into contact with the opening edges 104 of the ink tanks 41*c*, 41*y* on both ends, the outer walls 42 of the cartridge are not deformed inward when the cartridge is subjected to a vibration welding process.

Figure 10:
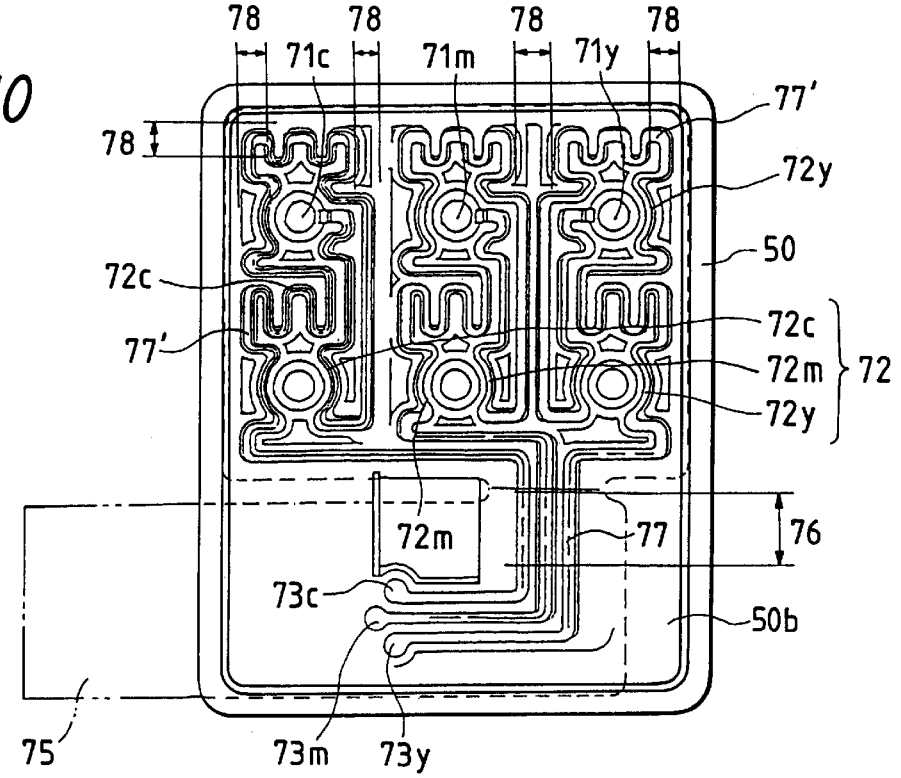
FIG. 10 is a top plan view of the cover body constructed in accordance with the invention.

As shown in FIG. 10, snake grooves 72*c*, 72*m*, 72*y* are formed so as to be recessed labyrinthlike in the upper surface 50*b* of the cover body 50, one respective end thereof extending to air release holes 71*c*, 71*m*, 71*y*, respectively. Further, the tail ends of the snake grooves 72*c*, 72*m*, 72*y* are led to a single place, and one of air communicating holes 73*c*, 73*m*, 73*y* of these snake grooves, for example, the air communicating hole 73*m* arranged on the tail end of the snake groove 72*m* for magenta in this embodiment, is projected in a film 75 peeling direction, so that the film 75 can be peeled off with ease.

These snake grooves 72 (72*c*, 72*m*, 72*y*) have the same shape independently of the cover bodies 50 of cartridges either being dedicated to monochromatic printing or color printing or having different ink capacities. As a result, molding costs can be reduced, and the snake grooves 72 can be covered with films 75 of the same width for a variety of cover bodies 50.

Considerations are given either 1) to prevent grooves 77, which are a part of grooves 72, from being clogged at a portion 76, at which the films are overlapped with the grooves 77, during a plurality of repeated film welding processes with a heater chip or 2) to prevent the grooves 77', which are a part of grooves 72, from being clogged by strong contact with the partitions 43 and the outer walls 42 of the ink cartridge at portions 78 (FIG. 10). That is, the snake grooves 72 are designed so that the width and depth of the grooves 77, 77' at the aforementioned portions 76, 78 are made large, i.e., the sectional areas of these portions 76, 78 are made large in order to prevent the clogging of the snake grooves during the welding operation.

While an example in which an ink cartridge is molded using polypropylene as a material has been described in the aforementioned embodiments, the present invention can be applied also to ink cartridges that are formed using a soft synthetic resin that does not permeate moisture such as high density polyethylene. Soft synthetic resins are those without sufficient structural integrity to maintain their shape without the structures described above.

Next, explanations with respect to the loading mechanism for the aforementioned ink cartridge will be provided.

Figure 11:
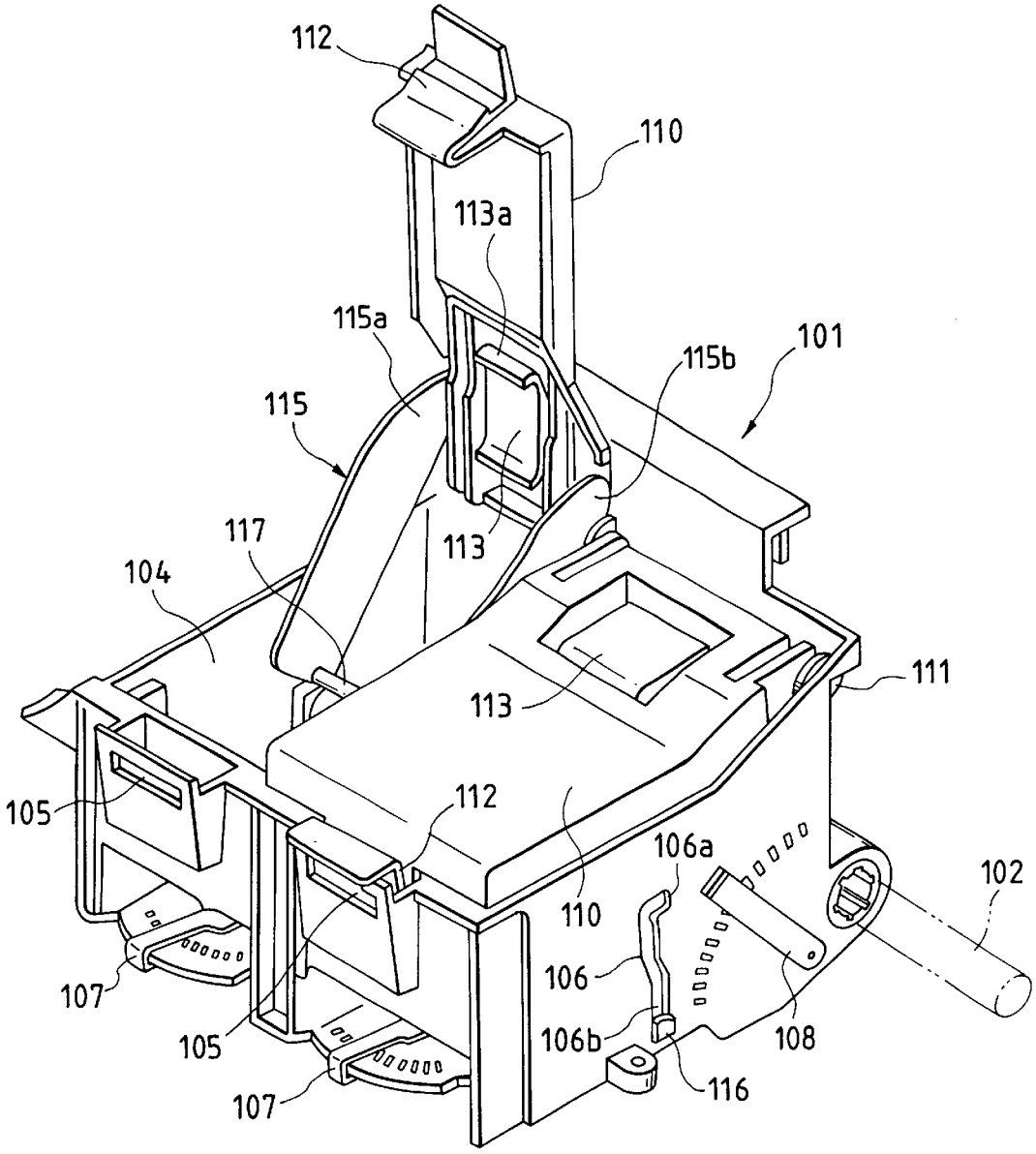
FIG. 11 is perspective view of a carriage having a cartridge loading mechanism constructed accordance with the present invention.
Figure 12A:
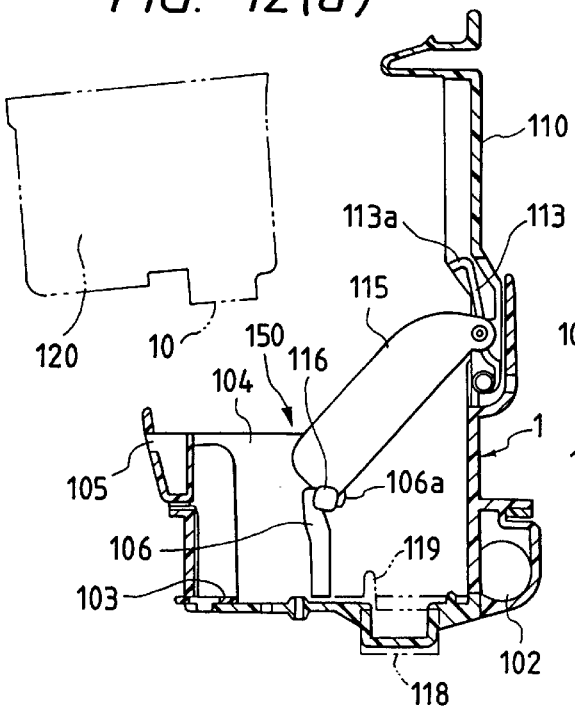
FIGS. 12(*a*) to 12(*d*) are sectional views of the cartridge loading mechanism illustrating the sequence of a cartridge loading operation in accordance with the present invention.
Figure 12C:
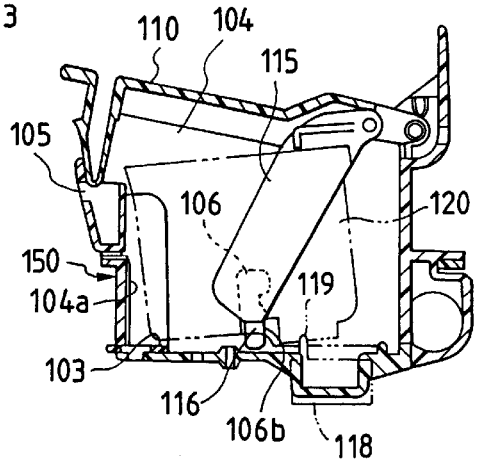
Figure 12B:
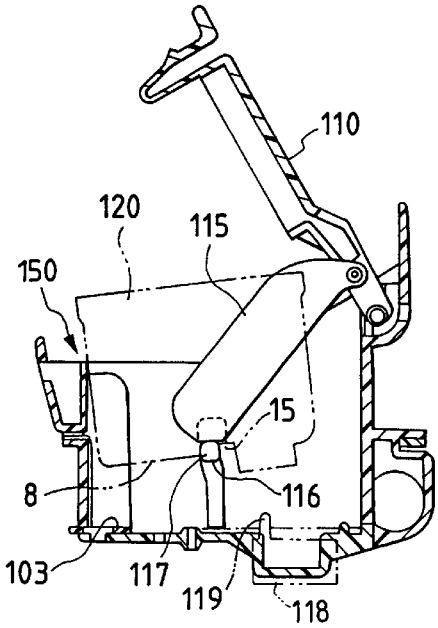
Figure 12D:
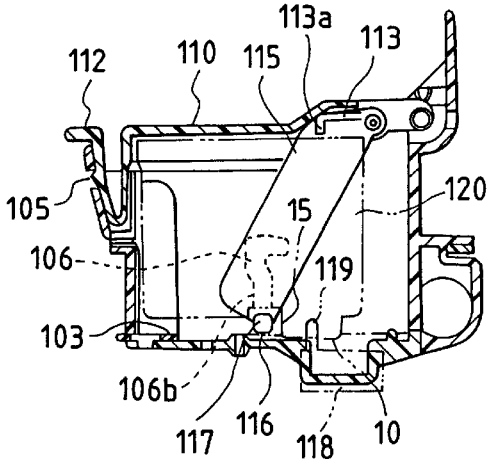
Figure 13:
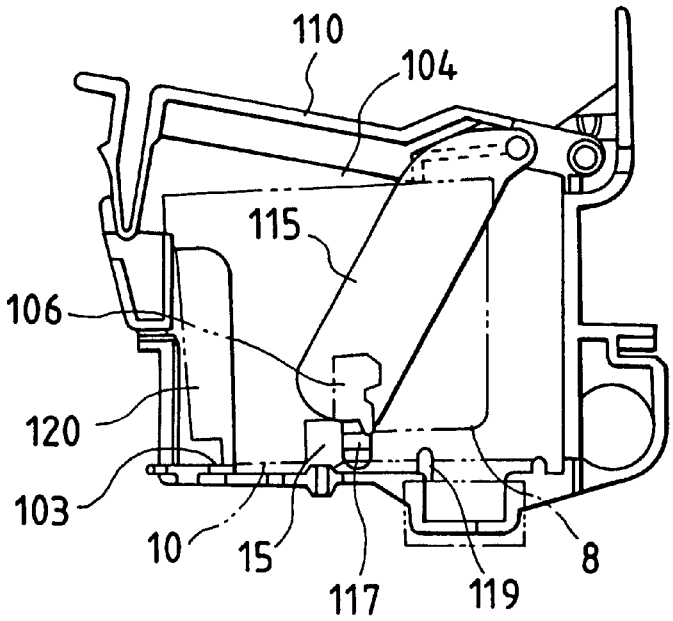
FIG. 13 is a schematic view showing a condition in which a cartridge is loaded with surfaces of the cartridge facing in wrong direction.

Reference is now made to FIGS. 11 to 13 which show an embodiment of the present invention, which is a loading mechanism, generally indicated as 101, that loads an ink cartridge 120 or 200 to the carriage of a color printer.

A carriage 101 also serves as an ink cartridge loading member. The carriage 101 travels in scanning directions while guided by a guide rod 102. The carriage 101 is designed to load two ink cartridges, one cartridge 120 for the black ink and the other cartridge 200 for the color inks. A recording head 118 is adjustably attached to the bottom surface 103 of the cartridge loading section 150 with an ink supply needle 119 projecting inward therefrom. The bottom surface 103 being opposite to an ink cartridge 120 setting opening 104 formed in cartridge loading section 150, providing access to the interior of cartridge loading section 150.

The carriage 101 has a guide groove 106 on a side surface of each cartridge loading section 150, the guide groove 106 serving to guide the lower free end of a lifter 115 that will be described later. A carriage cover body 110 is pivotally disposed on carriage loading section 150 to selectively close opening 104.

A latchlike portion 106*a* formed on the upper end of the guide groove 106 allows a carriage cover body 110 to be held in an opened position through the lifter 115. A vertical portion 106*b* formed in the lower half of the guide groove 106 allows an ink cartridge 120 disposed in lifter 115 to descend and ascend vertically with respect to the recording head 118. The vertical portion 106*b* extends in parallel to the axial center of the ink supply needle 119.

The carriage cover body 110, which turns about a pivot pin 111, is pivotally attached to an upper end portion of the carriage 101 on the guide rod 102 side of the setting opening 104. The carriage cover body 110 includes a catching piece 112. Carriage 101 is formed with a retaining portion adapted to receive and selectively capture catching piece 112. Carriage cover body 110 is designed to be opened and closed by engaging and disengaging catching piece 112 with and from retaining portion 105. The catching piece 112, whose cross section is U-shaped, is formed integrally with the free end portion of the carriage cover body 110, and the retaining portion 105 is formed on the other side of the carriage setting opening 104 from pivot pin 111.

A cantilevered cartridge pressing piece 113 is disposed on the inner surface of carriage cover body 110. The cartridge pressing piece 113 may be formed integrally with carriage cover body 110 by cutting the three sides of a portion of the carriage cover body 110 on the pivot pin 111 side away from the carriage cover body 110 while leaving a single side thereof uncut. A free end portion 113*a* of the cartridge pressing piece 113 that projects downward towards opening 104 when the carriage cover body 110 closed is pressed onto the top surface of the ink cartridge 120 disposed within cartridge loading section 150, so that the ink supply needle 119 on the recording head 118 side can be inserted into an ink supply port 10 arranged on the bottom surface 8 of the cartridge 120.

Lifter 115 includes two arms 115*a*, 115*b*. The base end of each arm 115*a*, 115*b*, of the lifter 115 is pivotally attached to a portion of the carriage cover body 110, the portion being slightly closer to the free end portion 113*a* side than the pivot pin 111. Further, a projection 116 that projects from the end of outer lifter arm 115*a* away from carriage cover body is designed to be received by and slide along the guide groove 106. With the carriage cover body 110 fully opened, the carriage cover body 110 is retained in such fully opened position by projection 116 being received in the latchlike portion 106*a* on the upper end of the guide groove 106. Whereas, as the carriage cover body 110 is pivoted to a position immediately before closing, projection 116 travels through vertical portion 106*b* of guide groove 116 guiding lifter 115 so that the ink cartridge 120 on the lifter 115 is allowed to descend vertically down onto the recording head 118 in parallel to the axial center of the ink supply needle 119.

It may be noted that reference numerals 107, 107 denote angle adjusting levers that adjust the turning of the color and black recording heads 118 about not shown pivots and that reference numeral 108 denotes a nozzle position adjusting lever that adjusts the color recording head in a sheet forward direction with the black recording head 118 as a reference.

When the aforementioned ink cartridge 120 is loaded on the carriage 101, the engaging recess 15 of the ink cartridge main body 1 can be engaged with a support rod 117 formed between the lower ends of the lifter arms 115*a,* 115*b* so as to extend across the inside of the ink cartridge main body 1, only by dropping the ink cartridge 120 into the setting opening 104. If the cartridge is not oriented properly, rod 117 will not be received in engaging recess 115, so that cartridge 120 will not completely drop into opening 104, preventing body cover 110 from closing and preventing damaging ink supply needle 119. Also the widthwise strength of the ink cartridge 120 can be increased by increasing the modulus of section of the bottom surface 8.

Figure 14:
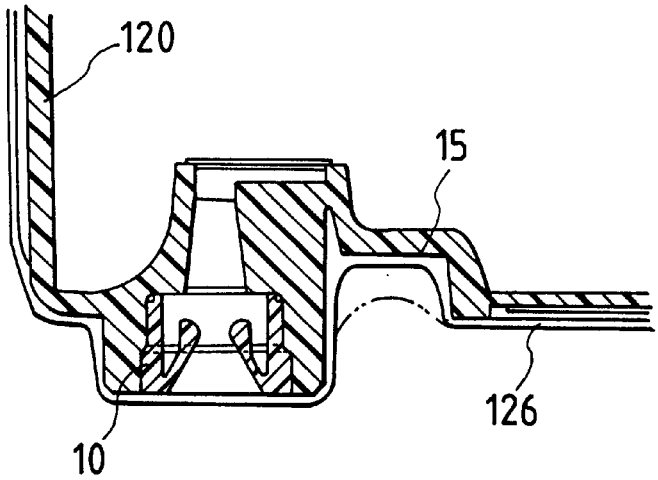
FIG. 14 is a sectional view showing part of the cartridge in a packaged condition in accordance with the invention.

Further, as shown in FIG. 14, at the time of vacuum-packaging the ink cartridge 120, a packaging material 126 is spread along the cartridge with the engaging recess 15 to the limit of elasticity thereof, so that a buffer function can be given, should air enter into the engaging recess 15. That is, the packaging material 126 has such a buffer function as to allow a negative pressure within the engaging recess 15 to be kept by the restitutive force of the material that tends to recover from inside the engaging recess 15 as shown by the two-dot chain line should air enter into the engaging recess 15.

In the thus constructed embodiment, the ink cartridge 120 can be loaded into the carriage 101 in the following way. As shown in FIG. 12(*a*), first, the carriage cover body 110 is opened, and the carriage cover body 110 is held in the fully opened position by causing the projection 116 on the lower end of the lifter 115 to be retained in the latchlike portion 106*a* of the guide groove 106. Then, the ink cartridge 120 is dropped into the setting opening 104 of the carriage 101 while positioned in such a manner that the ink supply port 121 confronts the ink supply needle 119.

As a result, as shown in FIG. 12(*b*), the engaging recess 15 arranged near the ink supply port 10 engages with the support rod 117 of the lifter 115, so that the ink cartridge 120 is held in such a position as to be inclined counterclockwise as viewed in FIG. 12(*b*) with a heavier portion thereof that is opposite to the ink supply port 10 positioned downward.

When the carriage cover body 110 is being closed under this condition, the ink cartridge 120 descends while guided by an inner surface 104*a* of the setting opening 104 closer to the retaining portion 105 as shown in FIG. 12(*c*). Then, as the projection 116, and in turn support rod 117 on the lower end of the lifter 115 reaches the vertical portion 106*b* of the lower half of the guide groove 106 to thereby allow the projection 116 to descend vertically, the ink cartridge 120 gradually changes the position thereof so as to be horizontal with the upper end of the inner surface 104*a* on the retaining portion 105 side as a fulcrum.

Finally, as the projection 116 on the lower end of the lifter 115 nears the lower end of the guide groove 106, the projection 116 causes the cartridge 120 to descend with the free end portion 113*a* of the cantilevered cartridge pressing piece 113 arranged on the carriage cover body 110 pressing the top surface of the cartridge 120 from above as shown in FIG. 12(*d*), so that the ink supply needle 119 located immediately below the cartridge 120 is allowed to pass through the ink supply port 10 while breaking the film. As a result, the recording head 118 is integrated with the ink cartridge 120 so as to communicate with each other.

On the other hand, if a new ink cartridge 120 must be set in place of the old ink cartridge 120 whose ink has run out due to recording that lasted for a long period of time, then the catching piece 112 is pressed to release the catching piece 112 and carriage cover body 110 from the retaining portion 105.

As a result, the carriage cover body 110 is ejected upward by elasticity of the cartridge pressing piece 113. When the carriage cover body 110 is further opened, the projection 116 that is guided by the vertical portion 106*b* of the guide groove 106 and lifter 115 raises the ink cartridge 120 set right above support rod 117 together with the lifter 115 with the position of the ink cartridge 120 unchanged. Then, the ink supply port 10 is removed from the ink supply needle 119 without damaging the ink supply needle 119. Hence, the ink cartridge 120 is ready to be taken out.

Therefore, the ink cartridge 120 is taken out while pinched with fingers by causing the ink cartridge 120 to ascend to the setting opening 104 while reversely performing the operations from FIGS. 12(*c*) to 12(*a*).

In contrast thereto, if the ink cartridge 120 is dropped with the side surfaces thereof facing in wrong directions, i.e., in such a position that the ink supply port 10 does not confront the ink supply needle 119, then the ink cartridge 120 is caused to descend with the engaging recess 15 unengaged with the support rod 116 of the lifter 115 as shown in FIG. 13. Therefore, the ink supply port 10 comes in contact with the bottom surface 103 of the carriage 1.

However, since the top surface of the ink cartridge 120 still projects from the setting opening 104 under this condition, not only can't the carriage cover body 110 be closed any further while disturbed by the projecting top surface of the ink cartridge 120, but also the ink cartridge 120 is not allowed to be pressed, either. Hence, the user is informed of such abnormal loading condition imnmediately, so that the ink supply needle 119 is prevented from being broken due to the ink cartridge being forced into the carriage.

By the way, the foregoing describes the present invention with reference to an example of a black ink cartridge 120, but the structure also works with an ink cartridge 200 to be loaded to the carriage of a color printer and an example of a loading mechanism for such ink cartridge. It further goes without saying that the present invention can be applied not only to monochromatic printers, but also to printers of such type that an ink cartridge is loaded on one side or both sides of the printer main body.

As described in the foregoing, according to the present invention, reinforcing ridges are arranged on the corner portions of peripheral walls of an ink tank, and the opening end edge of the ink tank is thick-walled. Therefore, the ink tank molded using a resin material that is hard to permeate with water vapor but that is soft, is given a sufficient rigidity. In addition, projecting portions that suppress deformation of the opening end edge are arranged outside longitudinally extending foam pressing projecting portions disposed on the inner surface of the cover body. Therefore, the ink tank is prevented from being deformed at the time of vibration welding, with not much sliding resistance produced at the time of welding the ink tank with the cover body.

Further, a rectangular frame is arranged around a cylindrical ink supply port so as to surround the ink supply port. Therefore, not only the ink supply port can be sealed easily as well as economically using a long film without cutting the corner portions of the film, but also such frame prevents erroneous attachment of the ink tank that is out of specification.

Still further, since a passage extending to an air release hole is formed on the inner surface of the cover body so as to maximize the length of the passage, even if an ink having a small surface tension that is easy to produce bubbles by evacuation is charged into the tank, the ink can be separated from the gas in the process of causing the ink to flow through the passage, which in turn allows only the gas to be discharged outside effectively and hence prevents contamination of the tank at the time of charging the ink.

Furthermore, a positioning engaging recess engageable with part of a lifter is arranged in the lower surface of a cartridge main body. Therefore, the cartridge main body can be correctly loaded to a predetermined position of a cartridge loading member through the lifter. In addition, even if the wall of the ink cartridge main body is made as thin as possible to maximize the capacity for containing ink, the engaging recess can increase the modulus of widthwise section of the ink cartridge main body, so that strength can be increased accordingly. Furthermore, a portion of the recess that projects inward of the ink cartridge main body decreases the size of the pores of a porous substance in this portion and increases the meniscus of the ink in such pores. Therefore, even if the amount of ink remaining in the porous substance is small, the ink is gathered close to an ink supply port, thus allowing the ink to be used up.

On the other hand, not only a guide portion extending in parallel to the ink supply needle of a recording head is arranged on one side of the cartridge loading member, but also the lifter that supports a portion of the cartridge on the ink supply port side is made displaceable along with the guide portion through the opening and closing operation of a carriage cover body. Therefore, only by opening and closing the cover body, the ink cartridge that is engageably supported on the lifter can be loaded or unloaded straight along the ink supply needle. As a result, not only the ink supply needle is prevented from being broken, but also if the ink cartridge is inserted with the side surfaces thereof facing in wrong directions, the ink cartridge is not allowed to engage with a support portion, which in turn does not allow the cover body to be opened or closed. Hence, the user can be informed of such abnormal setting condition immediately.

Still further, the ink cartridge is allowed to be loaded and unloaded with. a portion of the bottom surface thereof on the ink supply port side, not a side surface thereof, supported. Therefore, the projecting portion from the side surface of the cartridge is dispensed with, so that the capacity for containing ink is increased accordingly and the size of the cartridge loading member, i.e., the width of the carriage is decreased, which in turn contributes to downsizing a printer itself.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink cartridge comprising:

an ink cartridge main body, the ink cartridge main body being formed with walls forming corners; a reinforcing and positioning ridge being formed so as to project from a corner portion of at least one of said walls of said ink cartridge main body, an opening formed by said walls, an opening end edge disposed adjacent said opening and extending along said walls of said ink cartridge main body, said opening end edge being thick-walled; and a cover body covering said opening of said ink cartridge main body, and said cover body including a charged foam pressing ridge extending along said cover body, and being formed so as to project from an inner surface of said cover body to press a charged foam disposed in said ink cartridge main body; and a shape keeping ridge formed on said inner surface of said cover body, and extending from said charged foam pressing ridge towards said opening end edge and coming in contact with an inner surface of said opening end edge of said ink cartridge main body; said shape keeping ridge being tapered such that said inner surface of said opening end edge, when deformed inwardly, is gradually pressed into a correct shape when said cover body is placed on said cartridge main body, said charged foam pressing ridge being formed integrally with said shape keeping ridge.

2. The ink cartridge according to claim 1, wherein said ink cartridge main body is made of polypropylene.

3. The ink cartridge according to claim 1, wherein at least two of said walls extending in a direction orthogonal to a third and a fourth of said walls having a thickness greater than a thickness of said third wall and fourth wall.

4. The ink cartridge according to claim 1, said main body further comprising a bottom surface, an ink supply port, projecting from said bottom surface of said ink cartridge main body, and at least one positioning ridge integral with an outer circumferential surface of the ink supply port.

5. The ink cartridge according to claim 1, said main body further comprising a bottom surface, a cylindrical ink supply port projecting from the bottom surface of the ink cartridge main body, and a rectangular frame, said cylindrical ink supply port being disposed within said frame.

6. The ink cartridge according to claim 5, wherein a notch is formed on an edge of said frame, said notch releasing air when a film is bonded to said frame.

7. The ink cartridge according to claim 5, further comprising a plurality of ink supply ports formed so as to project from the bottom surface of the ink cartridge, a plurality of ribs, said ribs connecting said plurality of ink supply ports; and all of said ink supply ports being disposed within the frame.

8. The ink cartridge according to claim 1, said main body further comprising a bottom surface, a plurality of ink supply ports projecting from the bottom surface of said ink cartridge main body, a plurality of ribs, said ribs connecting said plurality of ink supply ports, and a rectangular frame, all of said ink supply ports being disposed within said frame.

9. The ink cartridge according to claim 1, said main body further comprising a bottom surface, an ink supply port formed on said bottom surface, and a recess formed in the bottom surface of said ink cartridge main body at a predetermined position relative to the ink supply port.

10. The ink cartridge according to claim 9, wherein said ink cartridge main body has a width and said recess extends across the width of said ink cartridge main body.

11. The ink cartridge according to claim 1, further comprising a labyrinthlike groove formed in an upper surface of said cover body, an air release hole formed in said cover body and one end of the groove communicating with the air release hole.

12. The ink cartridge according to claim 11, wherein said labyrinthlike groove formed in the upper surface of said cover body exhibits a snake shape, and whereby said snake shape prevents ink evaporation for cover bodies corresponding to a variety of ink capacities for ink cartridges.

13. The ink cartridge according to claim 11, further comprising a plurality of labyrinthlike grooves formed in the upper surface of said cover body of the ink cartridge; each of said labyrinthlike grooves including a tail end; a plurality of discharge holes formed on said cover body, each tail end corresponding to a respective discharge hole, a film covering at least a portion of said cover body; said film being peelable from said cover body in a film peeling direction and one tail end of said respective labyrinthlike grooves is positioned so as to project from other tail end discharge holes in the film peeling direction.

14. The ink cartridge according to claim 1, further comprising a plurality of ribs extending from said cover body, and an air release hole formed in said cover body, said ribs forming a zigzag passage between an end of said cover body and said air release hole.

15. The ink cartridge according to claim 14, wherein said ribs are integrally formed with an inner surface of said cover body.

16. The ink cartridge according to claim 14, wherein said cover body has an inner surface and one rib of said plurality of ribs formed on the inner surface of said cover body has a height so as not to come in contact with said charged foam, said one rib being close to the air release hole.

17. The ink cartridge according to claim 1, further comprising a plurality of ribs formed on said cover body, and an air release hole formed on said cover body, said cover body having an inner surface, one rib of said plurality of ribs formed on the inner surface of said cover body having a height so as not to come in contact with said charged foam, said one rib being close to the air release hole.

18. The ink cartridge according to claim 1, further comprising a plurality of ribs formed along an inner surface of said cover body, and an air release hole formed on said inner surface, said ribs forming a passage to the air release hole, and wherein part of said passage formed by said ribs is closed.

19. The ink cartridge according to claim 18, wherein said plurality of ribs is integrally formed with said cover body.

20. The ink cartridge according to claim 1, further comprising a groove formed around an outer peripheral portion of said cover body, said groove preventing scattering of burs produced as a result of vibration welding.

21. The ink cartridge according to claim 1, wherein said ink cartridge main body is formed with a confronting surface and said cover body is formed with a confronting surface, and further comprising a gap disposed between the confronting surfaces of said ink cartridge main body and said cover body.

22. The ink cartridge of claim 1, wherein said ink cartridge main body is molded from a soft synthetic resin material.

23. An ink cartridge for mounting upon a carriage having a lifter member which engages and guides the ink cartridge during mounting, comprising:

an ink cartridge main body;

a recess formed in said main body dimensioned and disposed to engage a part of the lifter member so that the lifter member guides the ink cartridge during mounting, said recess being formed in a lower surface of said ink cartridge main body, said recess having a top surface that is substantially flat.

24. The ink cartridge according to claim 23, further comprising an ink supply port formed in said lower surface at a predetermined position relative to the recess.

25. The ink cartridge according to claim 23, wherein said ink cartridge main body includes a least two opposed sides, the recess extending between both sides of said ink cartridge main body.

26. The ink cartridge according to claim 23, wherein said recess is formed so as to project into said ink cartridge main body.

27. An ink cartridge comprising an ink cartridge main body, said ink main body including a plurality of walls, said walls defining an opening, an opening end edge disposed adjacent said opening and extending along said walls of said ink cartridge main body;

a cover body covering said opening of said ink cartridge main body, and said cover body including a charged foam pressing ridge being formed so as to project from an inner surface of said cover body in a longitudinal direction and adapted to press a charged foam disposed in said ink cartridge main body; and a shape keeping ridge formed on said inner surface of said cover body, and extending from said charged foam pressing ridge towards said opening end edge and coming in contact with an inner surface of said opening end edge of said ink cartridge main body, said shape keeping ridge being tapered such that said inner surface of said opening end edge, when deformed inwardly, is gradually pressed into a correct shape when said cover body is placed on said cartridge main body, said charged foam pressing ridge being formed integrally with said shape keeping ridge.

28. The ink cartridge of claim 27, wherein said opening end edge is thicker than the remainder of said walls.

29. The ink cartridge of claim 27, wherein said ink cartridge main body is molded from a soft synthetic resin material.

30. An ink cartridge comprising:

an ink cartridge main body, said ink cartridge main body including a plurality of walls, said walls defining an opening, an opening end edge disposed adjacent said opening and extending along said walls of said ink cartridge main body;

a cover body covering said opening of said ink cartridge main body, and said cover body including a shape keeping ridge formed on an inner surface of said cover body; said shape keeping ridge being tapered such that said opening end edge, when deformed inwardly, is gradually pressed into a correct shape when said cover body is placed on said cartridge main body.

31. The ink cartridge of claim 30, wherein said opening end edge is thicker than the remainder of said walls.

32. The ink cartridge of claim 30, the ridge being formed integrally with said shape keeping ridge.

33. The ink cartridge of claim 30, wherein said ink cartridge main body is molded from a soft synthetic resin material.

34. A loading mechanism for an ink cartridge comprising;

a cartridge loading member having an opening, and ink supply needle disposed within said cartridge loading member communicating with a recording head and projected towards said opening;

a guide portion formed on one side of said cartridge loading member, said guide portion extending at least in part in a direction parallel to an axial center of the ink supply needle;

a cover body being pivotally attached to said cartridge loading member and selectively opening and closing said opening;

a lifter member having a free end portion, said lifter member being supported by the cover body, the lifter member having a lower end member being displaceable through said opening with a lower end thereof being guided by said guide portion; and a support rod mounted on said free end portion of said lifter member, said support rod supporting the ink cartridge when said support rod is engaged with a recess formed in a lower surface of the ink cartridge;

said guide portion facilitating a vertical descent of said ink cartridge, with said support rod engaged with said recess, such that an ink supply port on said ink cartridge descends in a direction substantially parallel to said axial center of said ink supply needle as said ink supply port is engaged with said ink supply needle.

35. The loading mechanism for an ink cartridge according to claim 34, further comprising a pressing portion disposed on an inner surface of said cover body, said pressing portion being elastically deformable, said pressing portion pressing an ink supply port toward the ink supply needle while coming in contact with a top surface of said ink cartridge as said cover body closes, the ink supply port being disposed on a lower surface of the ink cartridge.

36. An ink cartridge comprising:

an ink cartridge main body, said ink cartridge main body including a plurality of walls, said walls defining an opening; and an opening edge extending along said walls and which is disposed adjacent said opening; and a cover body covering said opening of said ink cartridge main body, said cover body having a vent hole, a length, an inner surface, and a plurality of substantially parallel charged foam pressing ridges substantially extending for the length of the cover body along said inner surface and projecting therefrom, said plurality of charged foam pressing ridges being adapted to press a charge foam disposed in said ink cartridge main body;

said vent hole being disposed between at least two of said parallel charged foam pressing ridges and being in direct fluid communication with an interior of the ink cartridge.

37. An ink cartridge for mounting upon a carriage having a lifter member which engages and guides the ink cartridge during mounting, comprising:

an ink cartridge main body, said ink cartridge main body having a first side and a second side, said-first and second sides being formed in a longitudinal direction, and sides formed in a lateral direction;

a recess formed in said main body in a lateral direction and dimensioned and disposed to engage a part of the lifter member so that the lifter member guides the ink cartridge during mounting, said recess being formed in a lower surface of said ink cartridge main body, said recess extending between and through said first and said second sides.

38. An ink cartridge for loading into a printer by a loading mechanism including a lifter member, comprising:

an ink cartridge main body; and a recess formed in said main body, said recess being dimensioned to receive said lifter member, said recess being formed in a lower surface of said ink cartridge main body.

39. An ink cartridge comprising:

an ink cartridge main body, said ink cartridge main body including a plurality of side walls and a bottom wall, said side walls defining an opening opposite said bottom wall; an opening edge extending along said side walls and disposed adjacent said opening, said side walls being free of ribs projecting into the space between said side walls; and a cover body covering said opening of said ink cartridge main body, said cover body having a length in a first direction and an inner surface, a plurality of substantially parallel tapered charged foam pressing ridges extending along said inner surface and projecting therefrom and substantially extending for the length of the cover body in said first direction, said plurality of charged foam pressing ridges being adapted to press a charged foam disposed in said ink cartridge main body;

said cartridge bottom having a length extending in said first direction, said ink cartridge main body having an ink supply port, said ink supply port being disposed on said cartridge bottom at a position closer to one end of said length than to the other;

said ink cartridge main body and said cover body defining an inner volume;

said ink supply port having a projecting portion, at least a portion of said projecting portion extending into said inner volume;

said tapered charged foam pressing ridges projecting further into said inner volume in a region opposite said ink supply port projecting portion.

* * * * *